US009284938B2

(12) United States Patent
Eguchi et al.

(10) Patent No.: US 9,284,938 B2
(45) Date of Patent: Mar. 15, 2016

(54) GLOW PLUG AND FABRICATION METHOD FOR SAME

(71) Applicant: NGK SPARK PLUG CO., LTD., Nagoya-shi, Aichi (JP)

(72) Inventors: Kazutaka Eguchi, Tajimi (JP); Shuei Ishii, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/356,722

(22) PCT Filed: Mar. 15, 2013

(86) PCT No.: PCT/JP2013/001751
§ 371 (c)(1),
(2) Date: May 7, 2014

(87) PCT Pub. No.: WO2013/145612
PCT Pub. Date: Oct. 3, 2013

(65) Prior Publication Data

US 2014/0326207 A1 Nov. 6, 2014

(30) Foreign Application Priority Data

Mar. 29, 2012 (JP) ..... 2012-075297

(51) Int. Cl.
*F23Q 7/00* (2006.01)
*F02P 19/02* (2006.01)
*F02B 3/06* (2006.01)

(52) U.S. Cl.
CPC ..... *F02P 19/026* (2013.01); *F23Q 7/00* (2013.01); *F23Q 7/001* (2013.01); *F02B 3/06* (2013.01);
(Continued)

(58) Field of Classification Search
CPC ..... F23Q 7/001; F02B 3/06; F02P 19/02; F02P 19/025; F02P 19/022
USPC ..... 123/145 A
See application file for complete search history.

(56) References Cited

U.S. PATENT DOCUMENTS 6,027,334 A 2/2000 Blaschke
6,411,038 B2 6/2002 Murai et al.
(Continued)

FOREIGN PATENT DOCUMENTS

DE 10 2006 014215 A1 9/2007
JP 10-506982 A 7/1998
(Continued)

OTHER PUBLICATIONS

"Road vehicles—M12x1,25 spark-plugs with flat seating and 14 mm bi-hexagon and their cylinder head housing", International Standard, ISO 22977, First edition, Jul. 15, 2005.
(Continued)

*Primary Examiner* — Lindsay Low
*Assistant Examiner* — Charles Brauch
(74) *Attorney, Agent, or Firm* — Sughrue Mion, PLLC

(57) ABSTRACT

A glow plug (1) has a housing (2) and a heater (3). The housing (2) includes a thread portion (5), a tool engagement portion (6), a press contact portion (7) brought into press contact with a plug seat surface of an engine upon screwing the thread portion (5) into a mounting hole of the engine, a front body portion (9) located between the press contact portion (7) and the thread portion (5) and a rear body portion (8) located between the tool engagement portion (6) and the thread portion (5). At least one of the front body portion (9) and the rear body portion (8) has a thickness smaller than or equal to a predetermined value and includes a plurality of reinforcing parts (9A, 8A) provided intermittently in a circumferential direction of the housing (2) in the form of protrusions or recesses extending in the direction of an axis CL1.

5 Claims, 8 Drawing Sheets

(52) U.S. Cl.
CPC ..... *F02P 19/02* (2013.01); *F02P 19/022* (2013.01); *F02P 19/025* (2013.01); *F23Q 2007/004* (2013.01); *Y10T 29/49083* (2015.01); *Y10T 29/49934* (2015.01)

(56) References Cited

U.S. PATENT DOCUMENTS

| | | | |
|---|---|---|---|
| 2001/0015402 | A1 | 8/2001 | Murai et al. |
| 2008/0302777 | A1 | 12/2008 | Ando |

FOREIGN PATENT DOCUMENTS

| | | | | |
|---|---|---|---|---|
| JP | 2001-182937 | A | | 7/2001 |
| JP | 2001-241661 | A | | 9/2001 |
| JP | 2002-174423 | A | | 6/2002 |
| JP | 2002174423 | A | * | 6/2002 |
| JP | 2002-303424 | A | | 10/2002 |
| JP | 2003-130349 | A | | 5/2003 |
| JP | 2008-089233 | A | | 4/2008 |
| JP | 2010210102 | A | | 9/2010 |
| JP | 2010-249354 | A | | 11/2010 |

OTHER PUBLICATIONS

"Internal combustion engines—Spark-plugs", JIS B 8031, 2006.

International Search Report of PCT/JP2013/001751 dated Apr. 23, 2013.

Communication dated Nov. 25, 2015 from the European Patent Office in counterpart application No. 13767933.8.

* cited by examiner (a) (b)

(a) (b)

GLOW PLUG AND FABRICATION METHOD FOR SAME

CROSS REFERENCE TO RELATED APPLICATIONS

This is a National Stage of International Application No. PCT/JP2013/001751 filed Mar. 15, 2013, claiming priority based on Japanese Patent Application No. 2012-075297 filed Mar. 29, 2012, the contents of all of which are incorporated herein by reference in their entirety.

FIELD OF THE INVENTION

The present invention relates to a glow plug for preheating of a diesel engine and a fabrication method for the glow plug.

BACKGROUND ART

Glow plugs are used to aid starting of internal combustion engines such as diesel engines. Each of the glow plugs has a cylindrical housing and a heater for generating heat upon energization thereof. As the heater, there can be used a ceramic heater having a conductive ceramic heating element or a sheath heater having a heating coil.

The housing includes a thread portion for mounting to the internal combustion engine, a tool engagement portion for engaging with a tool during mounting of the glow plug onto the internal combustion engine and a press contact portion for, upon screwing the thread portion into a mounting hole of the internal combustion engine, making press contact with a plug seat surface of the internal combustion engine so as to secure gastightness of a combustion chamber of the internal combustion engine.

The housing also includes a cylindrical front body portion located between the thread portion and the press contact portion. In the state where the glow plug is mounted onto the internal combustion engine, a compressive force (axial force) is exerted on the front body portion of the housing in an axis direction of the glow plug. Further, the housing may include a cylindrical rear body portion located between the thread portion and the tool engagement portion. A force (torsion stress) is exerted on the rear body portion of the housing in a circumferential direction of the housing during mounting of the glow plug onto the internal combustion engine by the tool (see e.g. Patent Document 1).

PRIOR ART DOCUMENTS

Patent Documents

Patent Document 1: Japanese Laid-Open Patent Publication No. 2008-89233

SUMMARY OF THE INVENTION

Problems to be Solved by the Invention

It is desirable to decrease the thickness of the housing and thereby reduce the weight of the housing for the purpose of improvement in fuel efficiency and reduction in fabrication cost. In the case where the housing is simply made thin, however, the front and rear body portions of the housing may deteriorate in mechanical strength. This results in possibilities of buckling deformation of the front body portion due to the application of the axial force and torsional deformation of the rear body portion due to the application of the torsion stress.

The present invention has been made in view of the above circumstances. It is an object of the present invention to provide a glow plug capable of, even when a housing of the glow plug is made relatively thin, more assuredly preventing deformation of front and rear body portions of the housing. It is also an object of the present invention to provide a fabrication method for the glow plug.

Means for Solving the Problems

Configurations suitable for achieving the above object of the present invention will be described below under the following headings. The specific functions and effects of these configurations will be also described as needed.

Configuration 1:

A glow plug, comprising:

a cylindrical housing having an axial hole in an axis direction of the glow plug and including, on an outer circumferential surface thereof, a thread portion for screwing in a mounting hole of an internal combustion engine; and a heater inserted in the axial hole with at least a front end portion of the heater protruding from a front end of the housing, wherein the housing further includes: a press contact portion brought into press contact with a plug seat surface of the internal combustion engine upon screwing the thread portion into the mounting hole of the internal combustion engine; and a cylindrical front body portion located between the press contact portion and the thread portion;

wherein the front body portion has a thickness of 1.6 mm or smaller when the thread portion has a thread diameter of M12 and a thickness of 0.9 mm or smaller when the thread portion has a thread diameter of M10, M9 or M8; and wherein the front body portion includes a plurality of front reinforcing parts provided intermittently in a circumferential direction of the housing in the form of either protrusions or recesses extending in the axis direction.

The expression "extending in the axis direction" includes not only the case where the front reinforcing parts extend strictly in the axis direction but also the case where the front reinforcing parts extends at a slight angle with respect to the axis direction (for example, when the cylindrical front body portion is developed on a plane, the acute angle between the direction of extension of the front reinforcing parts and the axis direction on the developed front body portion is 5° or smaller).

Configuration 2:

The glow plug according to configuration 1, wherein the housing further includes: a tool engagement portion located at a rear end side of the thread portion for engaging with a tool during mounting of the glow plug onto the internal combustion engine; and a cylindrical rear body portion located between the tool engagement portion and the thread portion;

wherein the rear body portion has a thickness of 1.6 mm or smaller when the thread portion has a thread diameter of M12 and a thickness of 0.9 mm or smaller when the thread portion has a thread diameter of M10, M9 or M8; and wherein the rear body portion includes a plurality of rear reinforcing parts provided intermittently in the circumferential direction of the housing in the form of either protrusions or recesses extending in the axis direction.

The expression "extending in the axis direction" includes not only the case where the rear reinforcing parts extend strictly in the axis direction but also the case where the rear reinforcing parts extends at a slight angle with respect to the axis direction (for example, when the cylindrical rear body portion is developed on a plane, the acute angle between the direction of extension of the rear reinforcing parts and the axis direction on the developed rear body portion is 5° or smaller). (The same applies to the following configuration 4.)

Configuration 3:

The glow plug according to configuration 1 or 2, wherein the front body portion has a holding part to hold the heater by an inner circumferential surface thereof; and wherein the front reinforcing parts are located at a rear end side of the holding part.

Configuration 4:

A glow plug, comprising:

a cylindrical housing having an axial hole in an axis direction of the glow plug and including, on an outer circumferential surface thereof, a thread portion for screwing in a mounting hole of an internal combustion engine; and a heater inserted in the axial hole with at least a front end portion of the heater protruding from a front end of the housing, wherein the housing further includes: a tool engagement portion located at a rear end side of the thread portion for engaging with a tool during mounting of the glow plug onto the internal combustion engine; and a cylindrical rear body portion located between the tool engagement portion and the thread portion;

wherein the rear body portion has a thickness of 1.6 mm or smaller when the thread portion has a thread diameter of M12 and a thickness of 0.9 mm or smaller when the thread portion has a thread diameter of M10, M9 or M8; and wherein the rear body portion includes a plurality of rear reinforcing parts provided intermittently in the circumferential direction of the housing in the form of either protrusions or recesses extending in the axis direction.

Configuration 5:

A method of fabricating the glow plug according to any one of configurations 1 to 4, comprising a housing production step of producing the housing, wherein the housing production step includes forming a plate-shaped metal material piece by deep drawing into a cylindrical semi-finished housing workpiece for production of the housing.

Effects of the Invention

In the glow plug of configuration 1, the front body portion has a thickness of 1.6 mm or smaller when the thread portion has a thread diameter of M12 and a thickness of 0.9 mm or smaller when the thread portion has a thread diameter of M10, M9 or M8. This leads to weight reduction of the front body portion, and by extension, weight reduction of the housing so as to allow improvement in fuel efficiency and reduction in fabrication cost.

On the other hand, there arises a fear of buckling deformation of the front body portion due to the application of an axial force when the front body portion is made thin as mentioned above. In the glow plug of configuration 1, however, a plurality of front reinforcing parts are provided on the front body portion intermittently in the circumferential surface of the housing in the form of protrusions or recesses extending in the axis direction. This makes it possible to significantly improve the strength of the front body portion so that the front body portion can be more assuredly prevented from becoming deformed due to the application of the axial force.

In the glow plug of configuration 2, the glow plug is so configured that the rear body portion has a thickness of 1.6 mm or smaller when the thread portion has a thread diameter of M12 and a thickness of 0.9 mm or smaller when the thread portion has a thread diameter of M10, M9 or M8. This leads to weight reduction of the rear body portion so as to further reduce the weight of the housing by synergy with the weight reduction of the front body portion in configuration 1 and thereby more effectively allow improvement in fuel efficiency and reduction in fabrication cost.

On the other hand, there arises a fear of torsional deformation of the rear body portion due to the application of a torsion stress when the rear body portion is made thin. In the glow plug of configuration 2, however, a plurality of rear reinforcing parts are provided on the rear body portion intermittently in the circumferential direction of the housing in the form of protrusions or recesses extending in the axis direction. This makes it possible to significantly improve the strength of the rear body portion so that the rear body portion can attain sufficient resistance to the torsion stress and be more assuredly prevented from becoming deformed due to the application of the torsion stress.

In the glow plug of configuration 3, the front reinforcing parts are located at a rear end side of the holding part in which the heater is held. In other words, the front reinforcing parts are located at positions apart from the holding part. This allows an inner circumferential surface of the holding part to be more assuredly brought into intimate contact with the heater and thereby makes it possible to attain good hermetic sealing between the heater and the holding part and ensure good gastightness of a combustion chamber.

In the glow plug of configuration 4, the rear body portion has a thickness of 1.6 mm or smaller when the thread portion has a thread diameter of M12 and a thickness of 0.9 mm or smaller when the thread portion has a thread diameter of M10, M9 or M8. This leads to weight reduction of the rear body portion, and by extension, weight reduction of the housing so as to allow improvement in fuel efficiency and reduction in fabrication cost.

Further, a plurality of rear reinforcing parts are provided on the rear body portion intermittently in the circumferential direction of the housing in the form of protrusions or recesses extending in the axis direction in the glow plug of configuration 4. This makes it possible to significantly improve the strength of the rear body portion so that the rear body portion can be more assuredly prevented from becoming deformed due to the application of a torsion stress.

In the glow plug fabrication method of configuration 5, the semi-finished housing workpiece, from which the housing is produced, is formed by deep drawing. This enables easier production of the entirely thin, light-weight housing for improvement in productivity.

As the housing is made thin as a whole, the weight of the housing can be further reduced so as to enhance the effects of improvement in fuel efficiency and reduction in fabrication cost.

BRIEF DESCRIPTION OF THE DRAWINGS

FIGS. 3(*b*) to (*d*) are elevation views showing the change of shape of the metal material piece by deep drawing; and FIG. 3(*e*) is an elevation view of a semi-finished housing workpiece.

FIG. 4(*b*) is a section view showing a state where the semi-finished housing workpiece is placed in the die.

FIG. 5(*b*) is an elevation view of the semi-finished housing workpiece on which the tool engagement portion has been formed.

DESCRIPTION OF THE EMBODIMENTS

Figure 1:
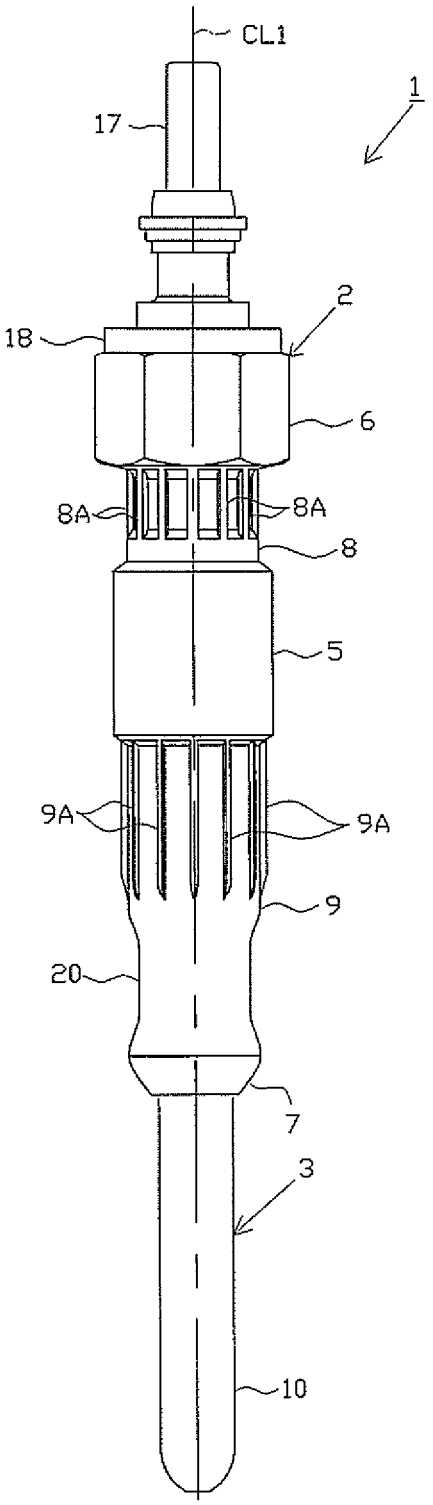
FIG. 1 is an elevation view of a glow plug according to one embodiment of the present invention.
Figure 2:
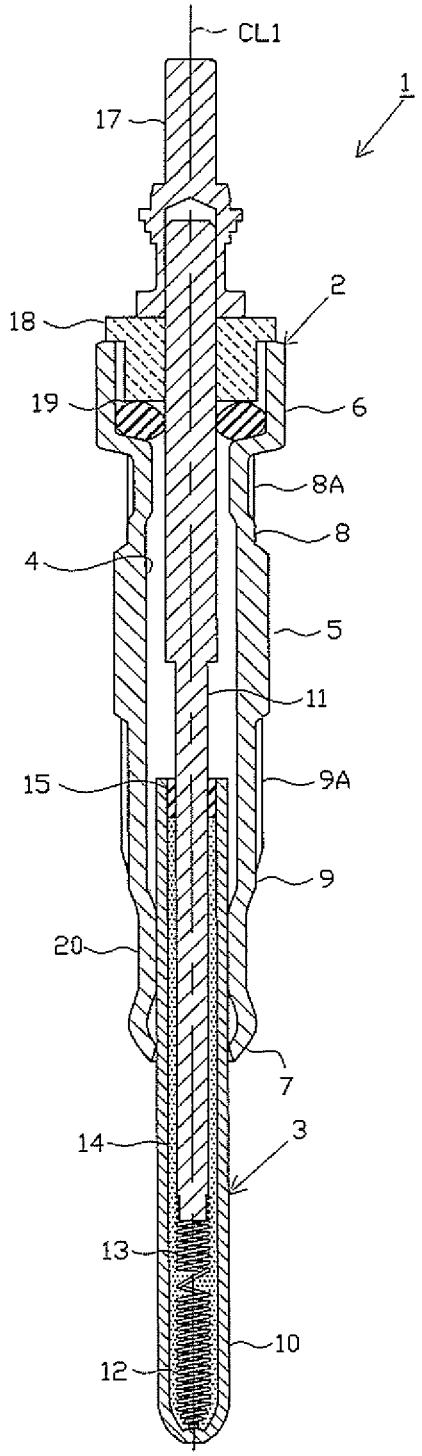
FIG. 2 is an elevation view, partially in section, of the glow plug according to the one embodiment of the present invention.

Hereinafter, exemplary embodiments of the present invention will be described below with reference to the drawings. FIG. 1 is an elevation view of a glow plug 1 according to one embodiment of the present invention. FIG. 2 is an elevation view, partially in section, of the glow plug 1. It is noted that: the direction of an axis CL1 of the glow plug 1 is set as the vertical direction of FIG. 1 etc.; and the lower and upper sides of FIG. 1 etc. are referred as front and rear sides of the glow plug 1, respectively.

As shown in FIGS. 1 and 2, the glow plug 1 includes a cylindrical housing 2 and a heater 3 fixed in the housing 2.

The housing 2 is made of a predetermined metal material (e.g. carbon steel or stainless steel). An axial hole 4 is formed in the housing 2 in the direction of the axis CL1. The housing 2 has, on an outer circumferential surface thereof, a thread portion 5 for screwing in a mounting hole of an internal combustion engine such as diesel engine and a hexagonal cross-section tool engagement portion 6 for engaging with a tool such as torque wrench during mounting of the glow plug 1 onto the internal combustion engine. In the present embodiment, the thread portion 5 is formed with a thread diameter of M12. Further, an inner circumference of part of the housing 2 corresponding in position to the tool engagement portion 6 is formed into a hexagonal cross-section shape in accordance with the outer circumferential shape of the tool engagement portion 6.

The housing 2 also has a press contact portion 7 located on a front end side thereof and, upon screwing the thread portion 5 into the mounting hole, brought into press contact with a plug seat surface (not shown) of the internal combustion engine so as to ensure good gastighness of a combustion chamber of the internal combustion engine by press contact of the press contact portion 7 with the plug seat surface.

In addition, the housing 2 has a cylindrical rear body portion 8 located between the thread portion 5 and the tool engagement portion 6 and a cylindrical front body portion 9 located between the press contact portion 7 and the thread portion 5. The front body portion 9 includes a holding part 20 having the smallest inner diameter within the axial hole 4 and holding the heater 3 by intimate contact of the entire circumference of an inner surface of the holding part 20 with the heater 3. In the present embodiment, the heater 3 is fixed in the housing 2, with a front end portion of the heater 3 protruding from a front end of the housing 2, by press-fitting the heater 3 into the holding part 20. The holding part 20 has the smallest outer diameter among the front body portion 9 in the present embodiment.

In the present embodiment, the housing 2 is made thin and substantially uniform in thickness as a whole. Each of the rear body portion 8 and the front body portion 9 is formed with a thickness of 1.6 mm or smaller. In the case where the thread diameter of the thread portion 5 is M8, M9 or M10, the thickness of the rear body portion 8 and the thickness of the front body portion 9 are each set to 0.9 mm or smaller. It is however preferable that each of the thickness of the rear body portion 8 and the thickness of the front body portion 9 is set to be larger than a predetermined value (e.g. 0.2 mm) in order to avoid excessive deterioration of the mechanical strength of the rear body portion 8 and the front body portion 9.

The heater 3 has a tube 10 and heating and control coils 12 and 13 placed in the tube 10. A center shaft 11, which is made of a predetermined metal material (e.g. iron-based alloy), is connected in series to the heating and control coils 12 and 13.

The tube 10 is made of a metal material containing iron (Fe) or nickel (Ni) as a main component (e.g. nickel-based alloy or stainless alloy) and formed into a cylindrical shape with a closed front end. The heating coil 12 and the control coil 13 are sealed together with an insulating powder 14 containing magnesium oxide powder in the tube 10, with a front end portion of the heating coil 12 joined to the front end of the tube 10 and a rear end portion of the heating coil 12 connected in series to the control coil 13. In this arrangement, a front end of the heating coil 12 is electrically conducted with the tube 10 although outer circumferential surfaces of the heating and control coils 12 and 13 are insulated from an inner circumferential surface of the tube 10 by the insulating powder 14.

An annular rubber member 15, which is made of a predetermined rubber material (e.g. silicon rubber or fluorine rubber), is disposed between the inner circumference of a rear end portion of the tube 10 and the center shaft 11 so as to seal the inside of the tube 10.

The heating coil 12 is formed by winding a resistive heating wire of predetermined metal material (e.g. alloy containing Fe as a main component and further containing Al and Cr etc.) into a spiral shape and is adapted to generate heat upon energization thereof through the center shaft 11.

The control coil 13 is formed from a resistive heating wire of material having a higher temperature coefficient of electrical resistance than the material of the heating coil 12, such as a metal material containing cobalt (Co) or Ni as a main component as typified by Co—Ni—Fe alloy etc. The control coil 13 increases in electrical resistance by heat generated from the control coil 13 itself and from the heating coil 12, so as to control the supply of power to the heating coil 12. More specifically, a relatively large amount of power is supplied to the heating coil 12 so that the temperature of the heating coil 12 rises rapidly in the early stage of energization. Under such heat generation, the control coil 13 is heated. Then, the amount of power supplied to the heating coil 12 decreases with increase in the electrical resistance of the control coil 13. The heater 3 thus shows temperature rise characteristics that, after allowing rapid temperature rise in the early stage of energization, controls power supply and thereby saturates the temperature by the action of the control coil 13. Namely, the heater 3 is configured to show improved temperature rise characteristics while reducing the tendency to cause excessive temperature rise (overshoot) of the heating coil 12 by the presence of the control coil 13.

The center shaft 11 is formed into a solid rod shape. A front end portion of the center shaft 11 is inserted in the tube 10.

The center shaft 11 and the control coil 13 are joined together by resistance welding the center shaft 11 to the control coil 13 while inserting a frontmost end region of the center shaft 11 in a rear end portion of the control coil 13.

A bottomed cylindrical terminal pin 17 for cable connection is crimped to a rear end portion of the center shaft 11. An insulating bushing 18, which is made of an insulating material, is disposed between a front end portion of the terminal pin 17 and a rear end portion of the housing 2 so as to prevent direct electrical conduction (short circuit) between the terminal pin 17 and the housing 2. An annular seal member 19, which is made of an insulating material, is disposed between the housing 2 and the center shaft 11 and held in contact with a front end portion of the insulating bushing 18 so as to improve the gastightness of the axial hole 4.

In the present embodiment, the thickness of the rear body portion 8 is set to be 1.6 mm or smaller or 0.9 mm or smaller as mentioned above. There is thus a possibility that the rear body portion 8 may undergo torsional deformation when a force is exerted on the tool engagement portion 6 in the circumferential direction during mounting of the glow plug 1 onto the internal combustion engine. Further, the thickness of the front body portion 9 is set to be 1.6 mm or smaller or 0.9 mm or smaller as mentioned above in the present embodiment. There is thus a possibility that the front body portion 9 may undergo buckling deformation when an axial force is exerted on the front body portion 9 during mounting of the glow plug 1 (housing 2) onto the internal combustion engine.

In view of these respects, the rear body portion 8 and the front body 9 are configured as follows in order to prevent deformation of the rear body portion 8 and the front body 9.

A plurality of front reinforcing parts 9A are provided intermittently in the circumferential direction of the housing 2 (in the present embodiment, twelve front reinforcing parts 9A are formed at even intervals) on the front body portion 9 in the form of protrusions extending in the direction of the axis CL1. The height of the front reinforcing parts 9A is adjusted depending on the number of the front reinforcing parts 9A. In the present embodiment, the height of the front reinforcing parts 9A is set to 0.1 mm or greater. Further, the length of the front reinforcing parts 9A in the direction of the axis CL1 is adjusted to be greater than or equal to a predetermined value (e.g. 30% of the length of the front body portion 9 in the direction of the axis CL1).

A plurality of rear reinforcing parts 8A are provided intermittently in the circumferential direction of the housing 2 (in the present embodiment, twelve rear reinforcing parts 8A are formed at even intervals) on the rear body portion 8 in the form of protrusions extending in the direction of the axis CL1. The height of the rear reinforcing parts 8A is also adjusted depending on the number of the rear reinforcing parts 8A. In the present embodiment, the height of the rear reinforcing parts 8A is set to 0.1 mm or greater. The length of the rear reinforcing parts 8A in the direction of the axis CL1 is also adjusted to be greater than or equal to a predetermined value (e.g. 30% of the length of the rear body portion 8 in the direction of the axis CL1).

Furthermore, the front reinforcing parts 9A are formed at rear end positions with respect to the holding part 20 such that the front reinforcing parts 9A do not reach the holding part 20 in the present embodiment.

The fabrication method of the above-structured glow plug 1 will be explained below. It is noted that conventional fabrication processes can be adopted for any parts and portions not specified below.

The heating coil 12 is formed by winding the resistive heating wire of e.g. alloy containing Fe as the main component and further containing Cr and Al into a coil shape. The control coil 13 is also formed by winding the resistive heating wire of e.g. Co—Ni—Fe alloy into a coil shape. Then, the rear end portion of the heating coil 12 is joined by arc welding to the front end portion of the control coil 13.

The tube 10 is provided in cylindrical form with its front end portion being unclosed. At this time, the diameter of the tube 10 is made larger by an amount of machining allowance than the final dimension. After the heating and control coils 12 and 13 are combined to the front end portion of the center shaft 11, the front end portion of the center shaft 11 and the heating and control coils 12 and 13 are placed in the tube 10. The front end portion of the tube 10 is subjected to arc welding so as to close the front end portion of the tube 10 and join the front end portion of the tube 10 to the front end portion of the heating coil 12.

The insulating powder 14 is filled into the tube 10. Subsequently, the tube 10 is subjected to swaging. With this, the heater 3 is obtained in which the tube 10 and the center shaft 11 are combined together.

Next, the housing 2 is produced in the following housing production step.

Figure 3:
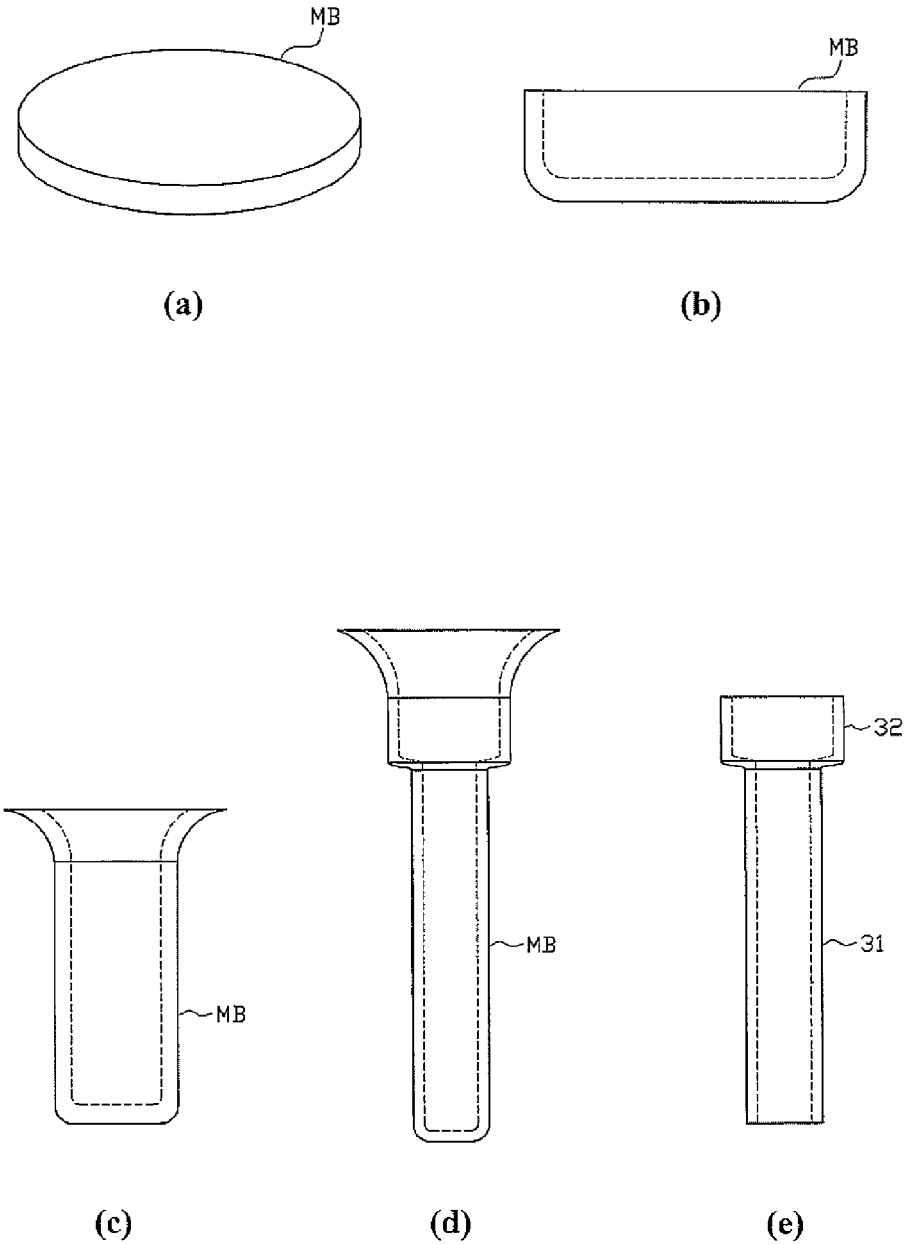
FIG. 3(*a*) is a perspective view of a metal material piece.

As shown in FIG. 3(*a*), a plate-shaped metal material piece MB of predetermined iron-based material is first prepared. The prepared metal material piece MB is subjected to deep drawing, thereby forming a cylindrical semi-finished housing workpiece 31 for production of the housing 2. Herein, a transfer press machine (not shown) is used in which a plurality of rod-shaped punches (not shown) gradually decreasing in outer diameter and a plurality of bottomed-cylindrical dies (not shown) corresponding in inner diameter to the outer diameters of the punches are mounted in alignment with one another. The metal material piece MB is set in the transfer press machine and pressed in multiple stages with the use of the punches and the dies so as to form the metal material piece MB into a cylindrical shape and gradually increase the depth of the cylindrical part as shown in FIGS. 3(*b*) to (*d*). Finally, the cylindrical semi-finished housing workpiece 31 is obtained by cutting away both end portions of the metal material piece MB. As shown in FIG. 3(*e*), the thus-obtained semi-finished housing workpiece 31 has on one end side thereof an engagement portion corresponding part 32 of relatively large diameter corresponding to the tool engagement portion 6. The diameter of a part of the semi-finished housing workpiece 31 located at a front end side of the engagement portion corresponding part 32 is made slightly larger than the final dimension of the housing 2.

Figure 4:
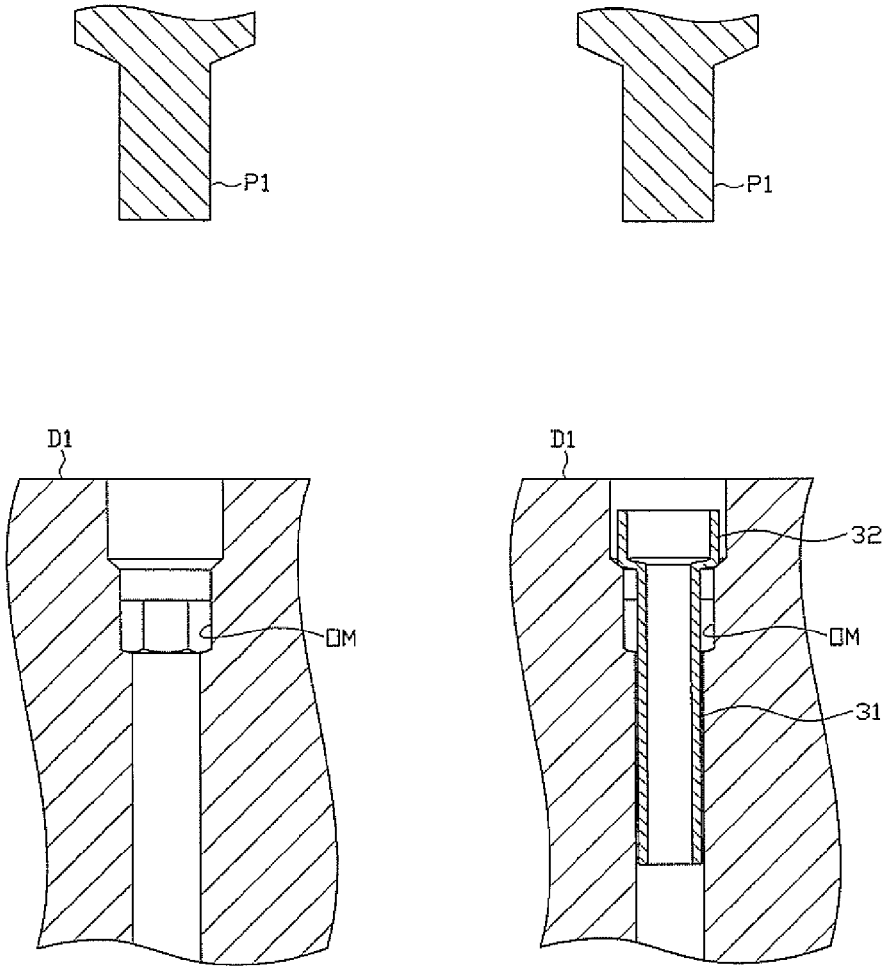
FIG. 4(*a*) is an elevation view, partially in section, of a die and a punch for formation of a tool engagement portion.
Figure 5:
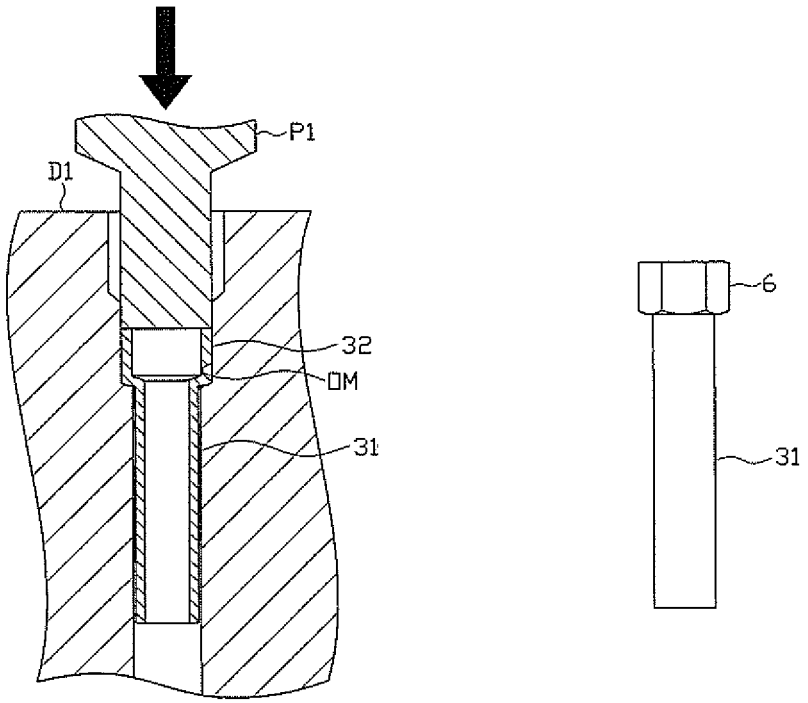
FIG. 5(*a*) is an elevation view, partially in section, showing an example of formation of the tool engagement portion.

After that, the tool engagement portion 6 is formed with the use of a die D1, which has on an inner circumference thereof an outer circumference forming part OM corresponding in shape to the outer circumferential shape of the tool engagement portion 6, and a vertically movable punch P1 as shown in FIG. 4(*a*). More specifically, the semi-finished housing workpiece 31 is placed in the inner circumference of the die D1 as shown in FIG. 4(*b*). The punch P1 is then moved downward so as to push the engagement portion corresponding part 32 into the outer circumference forming part OM of the die D1 by the punch P1 as shown in FIG. 5(*a*). As a result of this pushing operation, both of outer and inner circumferential surfaces of the engagement portion corresponding part 32 are formed into a hexagonal cross-section shape whereby the tool engagement portion 6 is formed as shown in FIG. 5(*b*).

The holding part 20 is formed by radially inwardly pressing the outer circumference of a front end part of the semi-finished housing workpiece 31 and thereby deforming a portion of the semi-finished housing workpiece 31 corresponding to the front body portion 9.

The front reinforcing parts 9A are formed by inserting a rod-shaped punch (not shown), which has on an outer circumference thereof protrusions corresponding to the inner circumferential shapes of the front reinforcing parts 9A, into the semi-finished housing workpiece 31 and pushing a die (not shown), which has on an inner circumference thereof recesses corresponding to the outer circumferential shapes of the front reinforcing parts 9A, against the semi-finished housing workpiece 31. The rear reinforcing parts 8A are also formed by inserting a rod-shaped punch (not shown), which has on an outer circumference thereof protrusions corresponding to the inner circumferential shapes of the rear reinforcing parts 8A, into the semi-finished housing workpiece 31 and pushing a die (not shown), which has on an inner circumference thereof recesses corresponding to the outer circumferential shapes of the rear reinforcing parts 8A, against the semi-finished housing workpiece 31. The rear reinforcing parts 8A and the front reinforcing parts 9A may alternatively be formed by any other process.

The thread portion 5 is formed by rolling on a given region of the semi-finished housing workpiece 31. Further, the press contact portion 7 is formed by pressing on a front end region of the semi-finished housing workpiece 31. In this way, the housing 2 is obtained.

The glow plug 1 is completed by press fitting the heater 3 in the holding part 20 of the housing 2, placing the insulating bushing 18 and the seal member 19 around the rear end portion of the center shaft 11, and then, crimping the terminal pin 17 to the rear end portion of the center shaft 11.

As described above, the thickness of the front body portion 9 and the thickness of the rear body portion 8 are set to be 1.6 mm or smaller when the thread diameter of the thread portion 5 is M12 and set to be 0.9 mm or smaller when the thread diameter of the thread portion 5 is M10, M9 or M8 in the present embodiment. It is therefore possible to effectively reduce the weight of the housing 2 for improvement in fuel efficiency and reduction in fabrication cost.

On the other hand, there arises a fear of deformation of the front body portion 9 due to the application of the axial force or deformation of the rear body portion 8 due to the application of the torsion stress when the front body portion 9 and the rear body portion 8 are made thin. In the present embodiment, however, a plurality of front reinforcing parts 9A are provided on the front body portion 9; and a plurality of rear reinforcing parts 8A are provided on the rear body portion 8. It is therefore possible to significantly improve each of the strengths of the front body portion 9 and the rear body portion 8 and more assuredly prevent deformation of the front body portion 9 due to the application of the axial force and deformation of the rear body portion 8 due to the application of the torsion stress.

Further, the front reinforcing parts 9A are located at a rear end side of the holding part 20 in which the heater 3 is held in the present embodiment. This allows the inner circumferential surface of the holding part 20 to be more assuredly brought into intimate contact with the heater 3. It is thus possible to attain good hermetic sealing between the heater 3 and the holding part 20 and ensure good gastightness of the combustion chamber.

As the housing 2 is made thin as a whole, the weight of the housing 2 can be further reduced so as to enhance the effects of improvement in fuel efficiency and reduction in fabrication cost.

Moreover, the holding part 20 has the smallest outer diameter among the front body portion 9 in the present embodiment. When the axial force is exerted on the front body portion 9 by mounting of the glow plug 1 onto the internal combustion engine, the axial force is decomposed toward the heater 3. It is thus possible to more assuredly prevent deterioration in the ability for the holding part 20 to hold the heater 3 even though the housing 2 (front body portion 9) is made thin as in the present embodiment.

The semi-finished housing workpiece 31, from which the housing 2 is produced, is formed by deep drawing. This enables easier production of the entirely thin, light-weight housing 2 for improvement in productivity.

The present invention is not limited to the above-described specific exemplary embodiment and can be embodied in the following alternative configurations. It is needless to say that any application/modification examples other than those described below are also possible.

Figure 6:
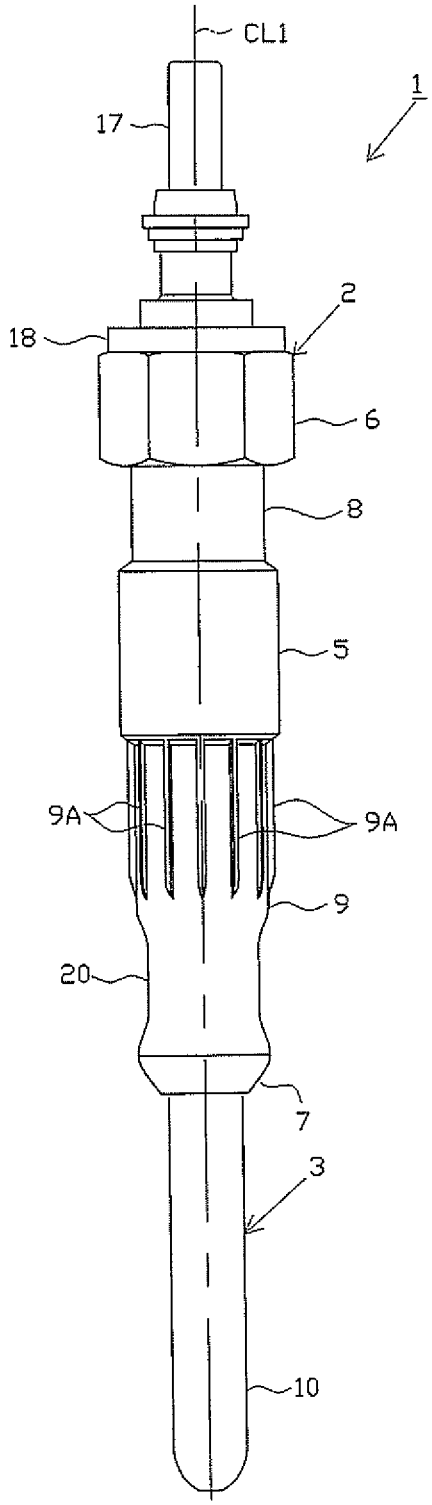
FIG. 6 is an elevation view of a glow plug according to another embodiment of the present invention.
Figure 7:
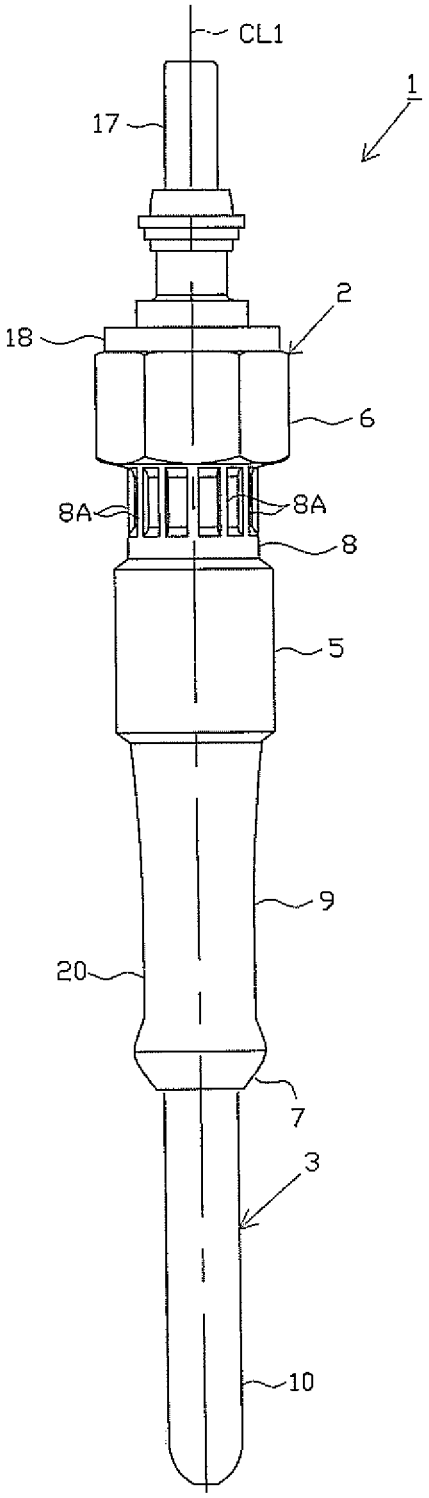
FIG. 7 is an elevation view of a glow plug according to still another embodiment of the present invention.

(a) Although both of the front reinforcing portion 9A and the rear reinforcing portion 8A are provided on the housing 2 in the above embodiment, it is alternatively feasible to provide only one of the front reinforcing portion 9A and the rear reinforcing portion 8A on the housing 2 as shown in FIGS. 6 and 7.

(b) Each of the front reinforcing parts 9A and the rear reinforcing parts 8A is provided in protrusion form in the above embodiment, but may alternatively be provided in recess (groove) form. It is also alternatively feasible to provide both of protrusion-form front reinforcing parts and recess-form front reinforcing parts and to provide both of protrusion-form rear reinforcing parts and recess-form rear reinforcing parts.

(c) The number of the front reinforcing parts 9A and the number of the rear reinforcing parts 8A in the above embodiment are merely examples. Each of the number of the front reinforcing parts 9A and the number of the rear reinforcing parts 8A can be varied as appropriate. The height of the front reinforcing parts 9A and the height of the rear reinforcing parts 8A (in the case where the front and rear reinforcing parts 9A and 8A are provided in the form of recesses, the depth of the front reinforcing parts 9A and the depth of the rear reinforcing parts 8A) can be adjusted depending on the number of the front reinforcing parts 9A and the number of the rear reinforcing parts 8A, respectively. When four front reinforcing parts 9A and four rear reinforcing parts 8A are provided at even intervals in the circumferential direction of the housing, for example, the depth (height) of the front reinforcing parts 9A and the rear reinforcing parts 8A may be set to 0.2 mm or larger.

(d) Although the rear body portion 8 is provided between the tool engagement portion 6 and the thread portion 5 in the above embodiment, it is alternatively feasible to provide no rear body portion so that the tool engagement portion 6 and the thread portion 5 are located adjacent to each other.

(e) Further, it is alternatively feasible to provide no control coil 13 and bring the center shaft 11 into direct contact with the heating coil 12 although the control coil 13 is provided between the heating coil 12 and the center shaft 11 so as to prevent excessive temperature rise of the heating coil 12 in the above embodiment.

(f) The technical idea of the present invention is applied to the so-called metal glow plug in which the heater 3 has the tube 10 and the heating coil 12 etc. placed in the tube 10 in the above embodiment. The technical idea of the present invention can also be applied to a so-called ceramic glow plug in which a heater has a cylindrical insulating ceramic substrate and a conductive ceramic heating element placed in the substrate and adapted to generate heat upon energization thereof through the center shaft 11. In this case, it is alternatively feasible to use a heater having a conductive coating film formed as the heating element on an outer surface of the substrate (i.e. so-called surface heating type heater). Further, at least a part of the heating element may be made of a high heat-resistant conductive metal material (e.g. alloy containing tungsten as a main component).

(g) In the above embodiment, the rear end part (cable connection part) of the glow plug 1 is configured by crimping the terminal pin 17 to the rear end portion of the center shaft 11. The configuration of the rear end part of the glow plug 1 is not however limited to this configuration. For example, it is feasible to form a male thread on the outer circumference of a part of the center shaft 11 protruding from the rear end of the housing 2, screw a nut having a female thread formed on an inner circumference thereof onto the male thread, with the nut held in contact with the insulating bushing 18, and thereby allow the rear end portion of the center shaft 11 to project through the nut such that the rear end portion of the center shaft 11 can serve as a cable connection part.

Figure 8:
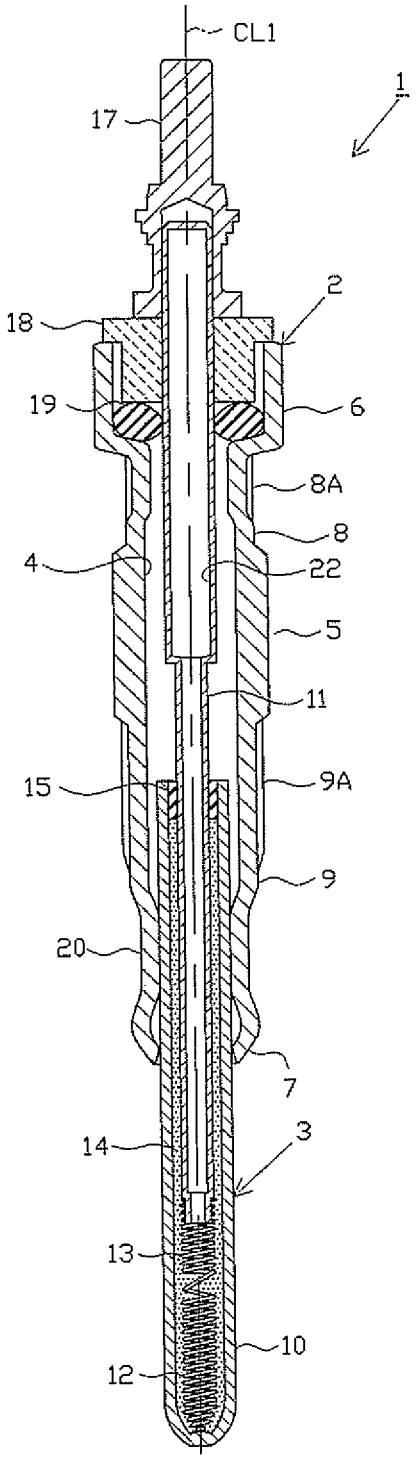
FIG. 8 is a section view of a glow plug according to yet another embodiment of the present invention.

(h) Although the center shaft 11 is formed into a solid rod shape in the above embodiment, it is alternatively feasible to form the center shaft 11 into a cylindrical shape such that the center shaft 11 has a hollow portion 22 inside thereof as shown in FIG. 8. In this case, it is possible to further reduce the weight of the glow plug 1 for further improvement in fuel efficiency. Further, the heat transferred from the heater 3 (heating coil 12) to the center shaft 11 can be reduced so as to allow the heater 3 (heating coil 12) to rapidly reach a given temperature level and decrease the amount of power supply required for the heater 3 to reach the given temperature level. The heat transferred from the control coil 13 to the center shaft 11 can also be prevented effectively so as to rapidly raise the temperature of the control coil 13 and thereby increase the resistance of the control coil 13. In consequence, it is possible to not only immediately exert the intrinsic function of the control coil 13 but also achieve further power savings.

(i) In the above embodiment, the semi-finished housing workpiece 31 is formed by deep drawing. The formation process of the semi-finished housing workpiece 31 is not however limited to such drawing process. The semi-finished housing workpiece may alternatively be formed by e.g. forging a predetermined metal material piece.

(j) The housing 2 may be locally increased or decreased in thickness although the whole of the housing 2 is made substantially uniform in thickness in the above embodiment. For example, it is feasible to make the holding part 20 larger in thickness than the other part of the front body portion 9 and hold the heater 3 in the large-thickness holding part 20.

(k) Although the tool engagement portion 6 is hexagonal in cross section in the above embodiment, the shape of the tool engagement portion 6 is not limited to this shape. The tool engagement portion 6 may alternatively be formed into a Bi-HEX shape (modified dodecagonal shape) (according to ISO 22977: 2005(E)) or the like.

(l) There is no particular limitation on the shape of the heater 3. The heater 3 may alternatively be oval, elongated round or polygonal in cross section. Further, the heater 3 may alternatively be configured as a so-called plate heater in which a heating element is embedded between a plurality of plate-shaped insulating substrates.

(m) There is also no particular limitation on the materials of the heating coil 12 and the control coil 13 although the specific materials of the heating coil 12 and the control coil 13 are cited as examples in the above embodiment.

DESCRIPTION OF REFERENCE NUMERALS

1: Glow plug
2: Housing
3: Heater
4: Axial hole
5: Thread portion
6: Tool engagement portion
7: Press contact portion
8: Rear body portion
8A: Rear reinforcing portion
9: Front body portion
9A: Front reinforcing portion
20: Holding part
31: Semi-finished housing workpiece
CL1: Axis
MB: Metal material piece

The invention claimed is:

1. A glow plug, comprising:

a cylindrical housing having an axial hole in an axis direction of the glow plug and including, on an outer circumferential surface thereof, a thread portion for screwing in a mounting hole of an internal combustion engine; and a heater inserted in the axial hole with at least a front end portion of the heater protruding from a front end of the housing, wherein the housing further includes on the outer circumferential surface thereof: a press contact portion brought into press contact with a plug seat surface of the internal combustion engine upon screwing the thread portion into the mounting hole of the internal combustion engine; and a cylindrical front body portion located between the press contact portion and the thread portion;

wherein the front body portion has a thickness of 1.6 mm or smaller when the thread portion has a thread diameter of M12 and a thickness of 0.9 mm or smaller when the thread portion has a thread diameter of M10, M9 or M8; and wherein the front body portion includes a plurality of front reinforcing parts provided intermittently in a circumferential direction of the housing in the form of either protrusions or recesses extending in the axis direction.

2. The glow plug according to claim 1, wherein the housing further includes: a tool engagement portion located at a rear end side of the thread portion for engaging with a tool during mounting of the glow plug onto the internal combustion engine; and a cylindrical rear body portion located between the tool engagement portion and the thread portion;

wherein the rear body portion has a thickness of 1.6 mm or smaller when the thread portion has a thread diameter of M12 and a thickness of 0.9 mm or smaller when the thread portion has a thread diameter of M10, M9 or M8; and wherein the rear body portion includes a plurality of rear reinforcing parts provided intermittently in the circumferential direction of the housing in the form of either protrusions or recesses extending in the axis direction.

3. The glow plug according to claim 1, wherein the front body portion has a holding part to hold the heater by an inner circumferential surface thereof; and wherein the front reinforcing parts are located at a rear end side of the holding part.

4. A glow plug, comprising:

a cylindrical housing having an axial hole in an axis direction of the glow plug and including, on an outer circumferential surface thereof, a thread portion for screwing in a mounting hole of an internal combustion engine; and a heater inserted in the axial hole with at least a front end portion of the heater protruding from a front end of the housing, wherein the housing further includes on the outer circumferential surface thereof: a tool engagement portion located at a rear end side of the thread portion for engaging with a tool during mounting of the glow plug onto the internal combustion engine; and a cylindrical rear body portion located between the tool engagement portion and the thread portion;

wherein the rear body portion has a thickness of 1.6 mm or smaller when the thread portion has a thread diameter of M12 and a thickness of 0.9 mm or smaller when the thread portion has a thread diameter of M10, M9 or M8; and wherein the rear body portion includes a plurality of rear reinforcing parts provided intermittently in the circumferential direction of the housing in the form of either protrusions or recesses extending in the axis direction.

5. A method of fabricating a glow plug, the glow plug comprising a cylindrical housing having an axial hole in an axis direction of the glow plug and a heater inserted in the axial hole with at least a front end portion of the heater protruding from a front end of the housing, the housing including a thread portion for screwing in a mounting hole of an internal combustion engine, a press contact portion brought into press contact with a plug seat surface of the internal combustion engine upon screwing the thread portion into the mounting hole of the internal combustion engine, a tool engagement portion located at a rear end side of the thread portion for engaging with a tool during mounting of the glow plug onto the internal combustion engine, a cylindrical front body portion located between the press contact portion and the thread portion and a cylindrical rear body portion located between the tool engagement portion and the thread portion, the cylindrical front body portion and the rear body portion being formed on the outer circumferential surface of the housing, at least one of the front body portion and the rear body portion having a thickness of 1.6 mm or smaller when the thread portion has a thread diameter of M12 and a thickness of 0.9 mm or smaller when the thread portion has a thread diameter of M10, M9 or M8 and including a plurality of reinforcing parts provided intermittently in a circumferential direction of the housing in the form of either protrusions or recesses extending in the axis direction, the method comprising a housing production step of producing the housing, wherein the housing production step includes forming a plate-shaped metal material piece by deep drawing into a cylindrical semi-finished housing workpiece for production of the housing.

* * * * *